US005471966A

United States Patent [19]

Feuling

[11] Patent Number: 5,471,966

[45] Date of Patent: Dec. 5, 1995

[54] ENGINE AIR INTAKE FILTER AND CRANKCASE BREATHER OIL COLLECTION ASSEMBLY

[76] Inventor: James J. Feuling, 2521 Palma, Ventura, Calif. 93003

[21] Appl. No.: 377,968

[22] Filed: Jan. 25, 1995

[51] Int. Cl.[6] ..... F02B 77/00

[52] U.S. Cl. ..... 123/572; 55/DIG. 19

[58] Field of Search ..... 123/572, 573; 55/DIG. 19, 461

[56] References Cited

U.S. PATENT DOCUMENTS

| | | | |
|---|---|---|---|
| 3,339,533 | 9/1967 | Nordstrom | 123/572 |
| 4,136,650 | 1/1979 | Manookian | 123/573 |
| 4,409,950 | 10/1983 | Goldberg | 123/572 |
| 4,459,966 | 7/1984 | Sakano et al. | 123/573 |
| 4,517,951 | 5/1985 | Otaka et al. | 123/572 |
| 4,627,406 | 12/1986 | Namiki et al. | 123/572 |
| 4,724,807 | 2/1988 | Walker | 123/196 A |
| 4,920,930 | 5/1990 | Sakano et al. | 123/573 |
| 5,140,957 | 8/1992 | Walker | 123/198 E |

FOREIGN PATENT DOCUMENTS

| | | | |
|---|---|---|---|
| 1576405 | 4/1970 | Germany | 123/572 |

*Primary Examiner*—David A. Okonsky

*Attorney, Agent, or Firm*—Frank D. Gilliam; John R. Duncan

[57] ABSTRACT

A combination intake air filter for an internal combustion engine and oil collection system for oil in crankcase breather fumes. An enclosed canister having a tubular side wall and two end walls houses a filter element, typically hollow frustum-shaped. A plurality of entrance openings around the periphery of one end wall admit intake air into the canister on one side of the filter element while a central exit opening in the opposite end wall directs the air to the engine after passing through the filter. The entrance openings are sized to create a predetermined pressure drop across the entrance. An inner wall spaced from the sidewall forms and annular space therebetween. An inlet at the top admits breather fumes into the annulus, with a barrier wall between the inner wall and sidewall forces the fumes to travel around the canister through the annulus to an exit connecting the annulus to the canister interior. A condensed oil exit removes oil condensed in the cool annulus and oil droplets forced into contact with the side wall by centrifugal forces. A small portion of the oil does not condense and serves to lightly wet the filter element to improve filter entrapment of very fine particles.

20 Claims, 2 Drawing Sheets

ENGINE AIR INTAKE FILTER AND CRANKCASE BREATHER OIL COLLECTION ASSEMBLY

BACKGROUND OF THE INVENTION

This invention relates in general to apparatus for filtering internal combustion engine intake air and, more specifically to an assembly that functions both to filter engine intake air and to collect and condense oil in fumes from the crankcase breather port.

A variety of different air filters have been designed over the years for filtering dust and the like out of engine inlet air to prevent the dust from entering the combustion chambers. Since abrasive dust can rapidly abrade engine components such as pistons, piston rings, valves, etc., it is important that the air filters have very high efficiency.

Many conventional engine air filters use an annular filter in a housing with air entering from an inlet to the filter exterior and passing to a carburetor connected to the filter interior. These filters have been developed to the point where they are quite effective. Some filters are used dry and some are coated with oil to increase entrapment of very fine particles. This filter design, however, is rather large and occupies an undesirably large volume in the engine compartment. Also, this large ring-like arrangement is not optimized for use with fuel injected engines, in particular diesel engines. Further, with the oil coated embodiment, it is difficult to maintain a uniform continuous very light oil coating at all times.

Slender, elongated, air filters having a frustum-shaped filter element have been developed, such as that described by Tokar et al. in U.S. Pat. No. 4,211,543. While these filters take up less engine compartment space than do annular filters, still there is no method for maintaining a slight, uniform and constant oil film to trap very fine particles.

Another problem in modern engines, both diesel and gasoline engines, is handling oil vapor and droplet containing fumes from crankcase breathers without emitting environmentally undesirable oil and other material into the atmosphere. Allowing these fumes to be simply be ducted to the atmosphere is no longer acceptable. Attempts have been made to capture these fumes and oil droplets in filters, condensing canisters, etc. with little success. Generally, these fumes are simply directed into the engine intake air and fed to the engine combustion chambers. This can result in poorly running engines, spark plug fouling (in spark ignition gasoline engines and the like), catalytic converter and fuel injector fouling, increased undesirable exhaust emissions. Other problems are caused as the air cleaner plugs up causing the draw on the crankcase to increase resulting in oil passing to the intake and cylinders.

Thus, there is a continuing need for internal combustion systems that prevent fine dust particles and excessive oil in crankcase breather fumes from entering the engine with intake air to reduce engine wear and oil fouling of components and improve the quality of exhaust gases entering the environment.

SUMMARY OF THE INVENTION

The above-noted problems, and others, are overcome in accordance with this invention by a combination engine air intake filter and engine breather oil collection assembly which comprises a closed canister having a tubular sidewall and two end walls, the first end wall having a plurality of entrance openings around the periphery thereof and the second end wall having a central exit opening. A filter, preferably in the shape of a hollow frustrum, is positioned in the canister with the base against the second end wall and the apex against the first end wall, so that substantially all air entering through the entrance openings passes through the filter and exits through the exit opening.

An inner wall is provided inside and approximately parallel to the canister sidewall. A crankcase breather fume entrance communicates with the annular space between the side wall and the inner wall. A barrier is provided to direct fumes entering through the fume entrance around the canister in one direction. An opening between the annular space and the interior of the canister is provided well spaced from the fume entrance, preferably at least 270° from the fume entrance and optimally adjacent to the barrier, allowing the fumes to travel in the annular space almost 360° around the canister.

Since the outer sidewall of the canister tends to be cool, oil in the breather fumes condenses in the annular chamber, and oil droplets in the breather fumes are forced against the outer wall by centrifugal forces. The condensed oil and accumulated droplets run down the annular space under gravitational forces. A condensed oil outlet opens from the canister exterior into the annular chamber to receive condensed oil. The oil can then be returned to the crankcase through conventional tubing, pumps, etc. as desired.

Preferably, the fume entrance and the oil outlet are on opposite sides of the canister, so that when the canister is installed with the fume entrance at the top and the oil outlet at the bottom, condensed oil is removed with maximum efficiency. Coalescing material helps capture the oil.

While most of the oil in the breather fumes is condensed, a small portion, in the form of vapor and very small droplets, passes into the canister interior, through the filter and out the air flow exit. Some of this remaining oil very lightly coats the filter element and traps very fine particles in the filter, significantly improving filter efficiency. Prior oil coated filters are treated with oil, then placed in a filter container. Initially, they are over coated, and as time passes, the oil is slowly evaporated to the point where particle entrapment no longer takes place. In the present case, the thin oil coating will be continuously replaced. Any oil vapor that is not trapped by the filter, or any excess beyond that which can be absorbed by the filter, will pass with the air stream to the combustion chambers and be burned. Since the portion of the oil passing through the filter is very small, carbon build-up and fouling problems at spark plugs plugs, catalytic converter, etc. are insignificant. The pressure differential allows movement of fumes to the air/oil separator.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
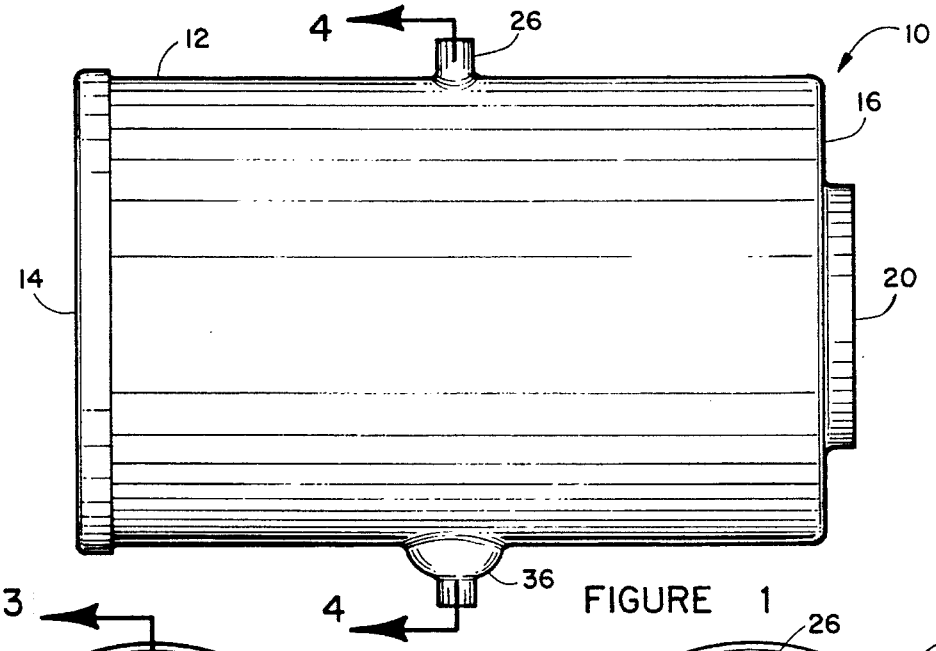
FIG. 1 is a schematic side elevation view of the assembly of this invention.
Figure 2A:
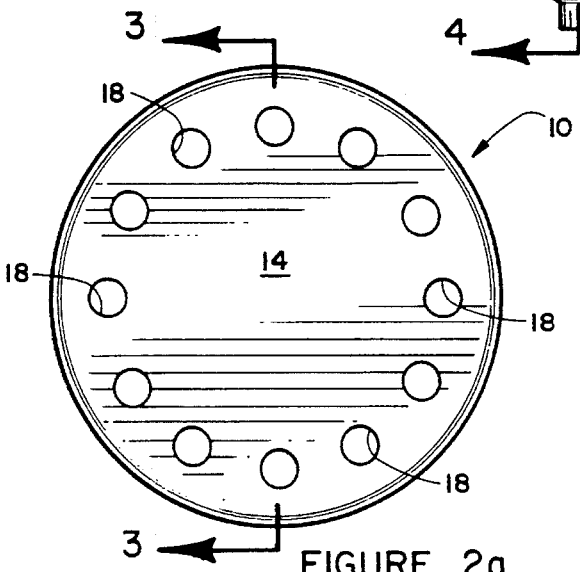
FIG. 2*a* is a schematic left end elevation view of the assembly showing plural round entrance openings.
Figure 2B:
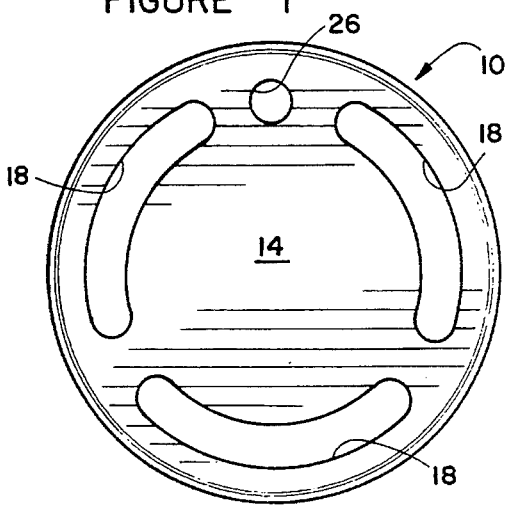
FIG. 2*b* is a schematic left end elevation view of the assembly showing plural arcuate segment openings.

Referring to FIGS. 1, 2*a* and 2*b*, there is seen a generally cylindrical filter assembly 10 having a tubular side wall 12, an air flow entrance end 14 and an air flow exit end 16. Entrance end 14 is preferably in the form of a removable end cap that is secured to side wall 12 in any suitable manner, such as with threads, bayonet connections or the like. An end cap can be replaced with another having a different total entrance opening cross sectional area or opening configuration to optimize the assembly for a particular engine operating under particular conditions.

A plurality of peripheral openings 18 are provided in entrance end 14 for admission of air into the filter assembly. The cross sectional area of openings 18 is selected to give an optimum slight pressure differential (subatmospheric) across entrance end 14, which may vary with different applications. Plural round openings 18 may be used as shown, or fewer but larger (preferably arcuate rather than round) openings 18 can be used if desired, as shown in FIG. 2*b*.

Entrance end 14 is conventionally secured into a tube or cap (not shown) which ducts air to the filter. A single centrally located air flow exit opening 20 is provide in the second, exit, end 16 of filter 10. Opening 20 is connected to conventional means for directing air to a carburetor, fuel injection system or the like. While a cylindrical canister, as shown, is preferred for simplicity of manufacture, if desired other cross sections, such as elliptical, may be used if desired.

A filter element 22 is provided within the canister for filtering particulate material from the incoming air. Any suitable filter medium may be used, such as open cell foam, porous paper, cloth or cotton gauze. The filter may have any suitable configuration, such as a multi-layer or pleated form. While filter element 22 could have other shapes, such as cylindrical, the frustum shape shown is preferred for highest efficiency and greatest surface area. The ends of filter element 22 are secured to the inner surfaces of the end walls in any suitable manner that prevents significant air flow other than through the filter medium. Suitable brackets, gluing, or other attachment means may be used, as desired.

Figure 3:
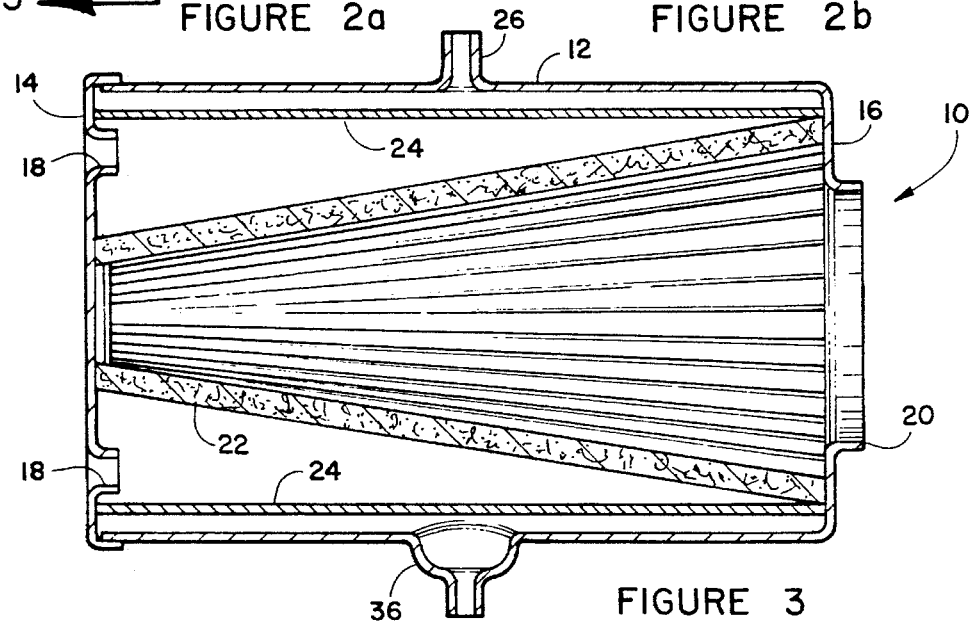
FIG. 3 is a schematic section view taken on line 3—3 in FIG. 2.
Figure 4:
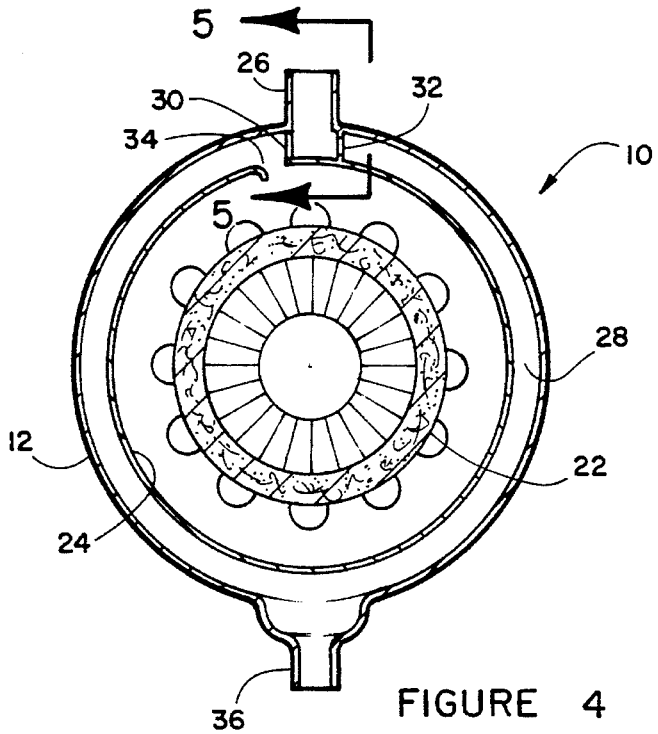
FIG. 4 is a schematic section view taken on line 4—4 in FIG. 1.

As best seen in FIGS. 3 and 4, an inner wall 24 is provided adjacent to and spaced from side wall 12. While the space between inner wall 24 and sidewall 12 may vary as desired, in most cases a parallel relationship is preferred. Preferably, the space between inner wall 24 and side wall 12 will be from about 0.5 to 1.5 inch with an overall canister diameter of from about 8 to 20 inches.

At least one breather fume entrance 26 penetrates through side wall 12 and communicates with the annulus 28 formed by side wall 12 and inner wall 24. While a single breather fume entrance 26 is preferred in most cases, additional entrances may be provided, if desired, spaced along a longitudinal line generally parallel with the canister axis.

Figure 5:
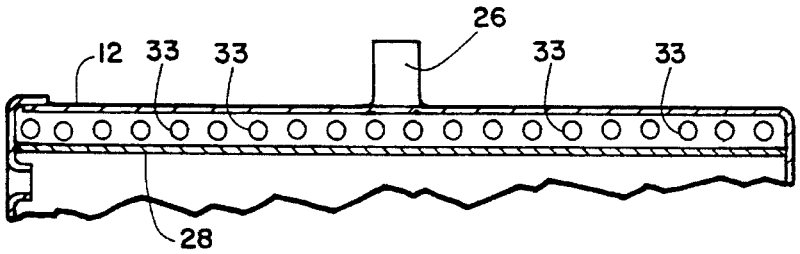
FIG. 5 is a schematic section view taken on line 5—5 in FIG. 4.

A solid, imperforate longitudinal wall 30 extends between inner wall 24 and side wall 12 adjacent to breather fume entrance 26, sealing off annulus 28 along that line. On the opposite side of breather fume entrance 26, a perforated wall 32 (as seen in section in FIG. 5) is provided between inner wall 24 and sidewall 12. Wall 32 contains any suitable number of openings 33 spaced along the length of the wall. Walls 30 and 32 support inner wall 24 against forces generated by the incoming breather fumes. If desired, other perforated walls may be provided at suitable locations around the canister circumference to further support inner wall 28.

Crankcase breather fumes entering through entrance 26 are directed into annulus 28 through perforated wall 32 and travel around the canister circumference to exit 34 where the fumes are directed from annulus 28 into the interior of the canister, outside of filter element 22. While exit 34 could be a longitudinal slot or have any other suitable shape, a plurality of closely space holes is preferred to maintain inner wall strength at that point.

As the crankcase breather fumes, which contain both small engine oil droplets and oil vapor, pass along annulus 28, larger droplets are forced against the inner surface of side wall 12 where they coalesce and oil vapor is cooled and condenses against that surface. The condensed oil runs downwardly under the force of gravity to a condensed oil outlet 36, which is positioned at the bottom of canister assembly 10 when in place on an engine.

Figure 6:
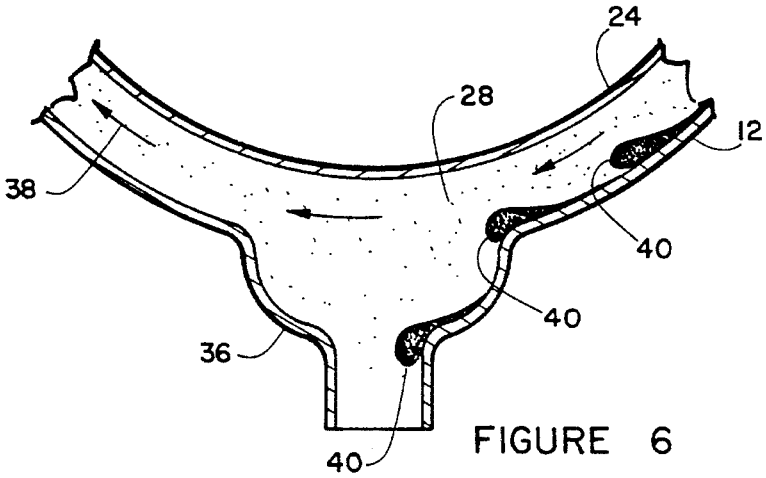
FIG. 6 is a detail section view through the oil outlet schematically showing the fume and collected oil flow paths.

The detail section view of FIG. 6 illustrates the relative flows of breather fumes in annulus 28 by arrows 38 and the flow of condensed oil 40 out through oil outlet 36. The condensed oil can be returned to the engine crankcase through any conventional tubing and pump (if necessary) means, not shown.

While any suitable relative orientation of breather fume entrance 26 and condensed oil outlet 36 may be used, preferably they are on opposite sides of the canister so that when the canister is installed in an engine the entrance 26 will be at the top and outlet 36 will be at the bottom.

While certain preferred materials, dimensions and arrangements have been described in detail in conjunction with the above description of preferred embodiments, those can be varied, where suitable, with similar results. Other applications, variations and ramifications of this invention will occur to those skilled in the art upon reading this disclosure. Those are intended to be included within the scope of this invention as defined in the appended claims.

I claim:

1. An engine air intake filter and crankcase breather oil collection assembly which comprises:

an enclosed canister having a generally tubular sidewall;

an air flow entrance end cap closing a first end of said sidewall and having a plurality of entrance openings adjacent to the periphery thereof;

an air flow exit end closing the second end of said sidewall and having a centrally located exit opening;

a filter means within said canister between said air flow entrance and exit;

an inner wall within and spaced from said sidewall forming an annular space therebetween;

at least one crankcase breather fume entrance opening into said annular space;

means for directing fumes entering through said breather fume entrance into said annular space in one direction around said annulus while preventing flow of said breather fumes in the opposite direction;

at least one condensed oil exit opening spaced from said breather fume entrance opening for discharging oil condensed in said annular space;

means for directing breather fumes from said annular space into said canister on the upstream side of said filter at a location spaced around said canister from said breather fume entrance;

whereby most of the oil in said breather fumes is condensed in said annular space and exits through said condensed oil exit for return to the engine crankcase while a small portion of said oil substantially continuously and uniformly coats said filter means to aid said filter in trapping very fine particles.

2. The assembly according to claim 1 wherein said filter is configured as the surface of a frustum, having a base at said second end and apex at said first end arranged so that substantially all air entering said entrance openings will pass through said filter means and exit through said exit opening.

3. The assembly according to claim 1 wherein said sidewall is substantially cylindrical.

4. The assembly according to claim 1 wherein said inner wall is substantially uniformly spaced from said side wall.

5. The assembly according to claim 1 wherein said means for directing breather fumes from said annular space into the interior of said canister is located closely adjacent to said breather fume entrance.

6. The assembly according to claim 1 wherein said means for directing fumes entering through said breather fume entrance in one direction comprises a plurality of spaced holes in a longitudinal wall between the inner surface of said side wall and said inner wall.

7. The assembly according to claim 1 wherein said means for preventing flow of said breather fumes in said opposite direction comprises an imperforate longitudinal wall between the inner surface of said side wall and said inner wall.

8. The assembly according to claim 1 wherein said plural entrance openings each has a cross section selected from the group consisting of circular and arcuate segment openings.

9. The assembly according to claim 1 wherein said end cap is removable and replaceable with an end cap having a different entrance opening cross sectional area.

10. The assembly according to claim 1 wherein said breather fume entrance opening is through said sidewall.

11. The assembly according to claim 1 wherein said breather fume entrance opening is through said end cap.

12. The assembly according to claim 1 wherein said entrance openings having a predetermined total cross sectional area to provide a predetermined pressure drop

13. An engine air intake filter and crankcase breather oil collection assembly which comprises:

a canister having a generally cylindrical sidewall;

an air flow entrance end cap closing a first end of said sidewall and having a plurality of entrance openings adjacent to the periphery thereof;

an air flow exit end closing the second end of said sidewall and having a centrally located exit opening;

a frustum shaped filter means within said canister and having a base at said second end and apex at said first end arranged so that substantially all air entering a said entrance openings will pass through said filter means and exit through said exit opening;

an inner wall within and substantially parallel to said sidewall forming an annular space therebetween;

at least one breather fume entrance opening into said annular space;

means for directing fumes entering through said breather fume entrance into said annular space in one direction around said annulus while preventing flow of said breather fumes in the opposite direction;

at least one condensed oil exit opening spaced from said breather fume entrance opening for receiving oil condensed in said annular space;

means for directing breather fumes from said annular space at least 270° around said canister from said breather fume entrance into said canister on the upstream side of said filter;

whereby most of the oil in said breather fumes is condensed in said annular space and exits through said condensed oil exit for return to the engine crankcase while a small portion of said oil substantially continuously and uniformly coats said filter means to trap very fine particles.

14. The assembly according to claim 13 wherein said means for directing breather fumes from said annular space into the interior of said canister is located closely adjacent to said breather fume entrance.

15. The assembly according to claim 13 wherein said means for directing fumes entering through said breather fume entrance in one direction comprises a plurality of spaced holes in a longitudinal wall between the inner surface of said side wall and said inner wall.

16. The assembly according to claim 13 wherein said means for preventing flow of said breather fumes in said opposite direction comprises an imperforate longitudinal wall between the inner surface of said side wall and said inner wall.

17. The assembly according to claim 13 wherein said plural entrance openings each has a cross section selected from the group consisting of circular and arcuate segment openings.

18. The assembly according to claim 13 wherein said end cap is removable and replacable with an end cap having a different entrance opening cross sectional area.

19. The assembly according to claim 13 wherein said breather fume entrance opening is through said sidewall.

20. The assembly according to claim 13 wherein said breather fume entrance opening is through said end cap.

* * * * *